United States Patent [19]

Daly

[11] 4,093,209

[45] June 6, 1978

[54] DIVING APPARATUS

[75] Inventor: Lewis J. Daly, Fayetteville, N.Y.

[73] Assignees: Robert C. Stevens, Pittsford; John M. Loftus, Scottsville, both of N.Y.

[21] Appl. No.: 782,059

[22] Filed: Mar. 28, 1977

[51] Int. Cl.[2] ..... A63B 5/10

[52] U.S. Cl. ..... 272/66

[58] Field of Search ..... 272/66, 65, 55, 135, 272/DIG. 4, 109; 273/DIG. 17

[56] References Cited

U.S. PATENT DOCUMENTS

| | | | |
|---|---|---|---|
| 3,003,763 | 10/1961 | Griffith, et al. | 272/66 |
| 3,083,965 | 4/1963 | Jewett | 272/66 |
| 3,321,204 | 5/1967 | Pretti | 272/66 |
| 3,795,397 | 5/1974 | Wilson | 272/66 |
| 4,017,069 | 4/1977 | Daly et al. | 272/66 |

*Primary Examiner*—William R. Browne
*Attorney, Agent, or Firm*—Bruns & Jenney

[57] ABSTRACT

A diving system for launching a person into a swimming pool or the like that is particularly well suited for use in a limited space which normally precludes the use of a conventional board. The system employs a relatively short board pivotally secured to a base member and having two arcuate shaped spring members that are anchored at one end in the base and which are cojoined at the opposite end by a crossbar passing under the board. The crossbar is arranged to ride in contact with the working surface of a slide affixed to the board so that rearward movement of the crossbar is promoted when the board is deflected under a relatively light load and is resisted when the board is deflected under a relatively heavy load. The slide includes a generally concave shaped working surface for receiving the crossbar and, automatically changes the fulcrum ratio of the system to present a more flexible board to a lighter or less active diver and a stiffer board to a heavier or more active diver. The slide extends generally longitudinally the board.

10 Claims, 6 Drawing Figures

DIVING APPARATUS

BACKGROUND OF THE INVENTION

This invention relates to a diving system and, in particular, to an improved diving platform of relatively short length which is capable of automatically delivering improved performance in response to the load imposed thereupon.

In copending U.S. patent application Ser. No. 626,297 filed Oct. 28, 1975, a diving platform of relatively short length is disclosed which, because of its unique features, exhibits a response that is generally characteristic of a longer more conventional board. The short board is pivotally mounted within a base member and supported between two arcuate shaped springs which extend upwardly and outwardly from the base. The board rests upon a crossbar supported between the terminal ends of the two arcuate shaped springs. As a result, the diving system is able to deflect under diver induced loads thereby imparting to the diver a feeling generally associated with a conventional spring board.

In the above noted prior art device, the crossbar is arranged to move along the flat bottom surface of the board as the bar is forced back under load. The movement of the bar over the board can produce a chattering under certain conditions. A friction pad may be inserted between the two members to mask the chattering effect. However, even with the pad, the "feel" of the board presented to the diver might be slightly different than that produced by a conventional board and therefore might have a disturbing or distracting effect. Furthermore, the short board, because it is spring loaded, tends to be relatively noisy on rebound. Continuous impacting of the crossbar against the friction pad also sets up unwanted cold stresses in the pad which considerably shortens its life.

SUMMARY OF THE INVENTION

It is therefore an object of the present invention to improve diving platforms.

A further object of the present invention is to reduce the noise of rebound associated with a spring supported diving platform.

A still further object of the present invention is to provide a spring supported relatively short diving system with a mechanism for automatically adjusting the response of the board in accordance with the load imposed thereon.

Another object of the present invention is to provide a short diving platform having a relatively smooth response that is generally characteristic of a more conventional longer diving board.

These and other objects of the present invention are attained by means of a diving platform having a relatively short board pivotally mounted within a base member and being supported between two arcuate shaped cantilevered spring members anchored at one end in the base member and having a crossbar mounted between the free ends thereof upon which the board rests and at least one slide member secured to the bottom surface of the board and having a working surface being arranged to ride in contact with the crossbar, the working surface being contoured to promote deflection of the board when it is placed under a relatively light load and to resist deflection when it is placed uner an increasingly heavier load.

BRIEF DESCRIPTION OF THE DRAWINGS

For a better understanding of the invention as well as of the objects and further features thereof, reference is had to the following detailed description of the invention in conjunction with the accompanying drawings wherein.

DESCRIPTION OF THE PREFERRED EMBODIMENTS

Figure 1:
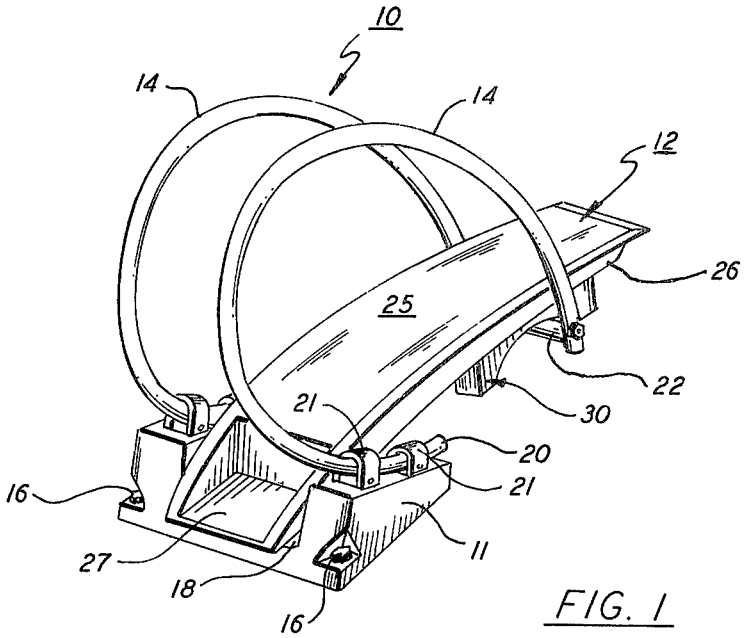
FIG. 1 is a perspective view of a diving system embodying the teachings of the present invention.
Figure 2:
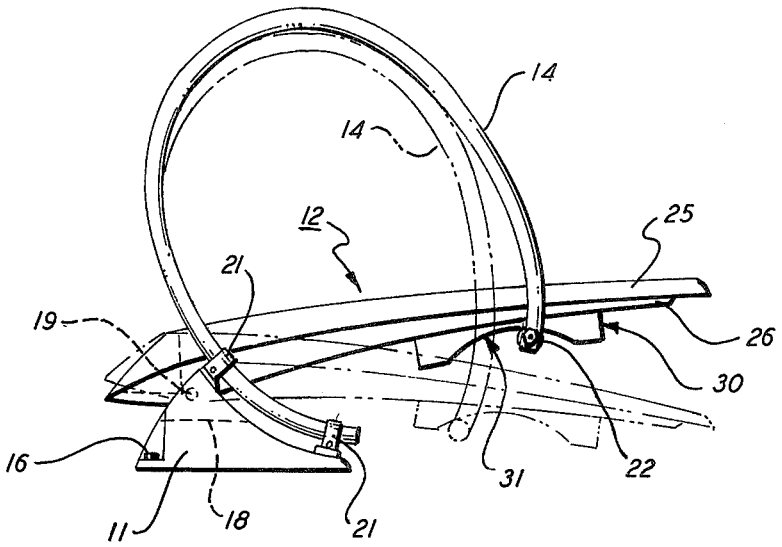
FIG. 2 is a side elevation of the diving system illustrated in FIG. 1 further showing in phantom lines an outline of the board in a deflected position.

Referring initially to FIGS. 1 and 2, the diving platform 10 of the present system includes a base member 11, a relatively short diving board 12 and a pair of arcuate shaped springs 14—14. The base, which can be formed of molded plastic, cast metal or the like, is typically secured via bolts 16 to a dock or the deck of a pool adjacent to the water's edge. A saddle-like depression 18 is provided in the base capable of accepting the board therein. In assembly, the board is pivotably mounted in the base by means of pin 19 with the board extending outwardly over the water.

The two spring members are secured in cantilever fashion in the base via clamps 21 acting on the inner ends 20 of the springs. The springs arch upwardly and outwardly with the free ends thereof passing adjacent to the sides of the board. A crossbar 22 is affixed by suitable means to the free ends of the springs and is arranged to pass beneath the board. As will be explained in greater detail below, the crossbar acts as a movable fulcrum in the system for changing the response thereof in reference to the force exerted by a diver upon the diving end of the board. In practice, the springs can be constructed of steel tubing preformed into an elliptical shape to deliver the desired response characteristics.

The board 12 is fabricated of any suitable material such as fiberglass, and includes a single piece top section 25 and an extended reinforcing member 26 bonded to the bottom of the top piece. The reinforcing member is bifurcated toward the outer or diving end of the board and acts in conjunction with the top section to impart the required strength to the board. A nonski surface for the safety and convenience of the diver is placed over the top of the board. A step 27 can also be formed in the back end of the board to facilitate mounting and dismounting of the platform.

Figure 3:
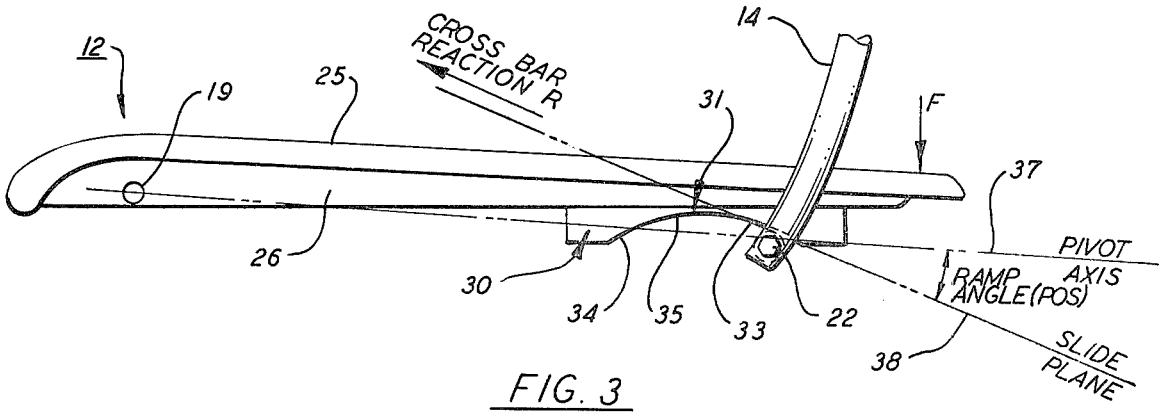
FIGS. 3 and 4 are partial diagrammatic views of the diving system shown in FIG. 1 illustrating the interrelationship of component parts under various load conditions.
Figure 4:
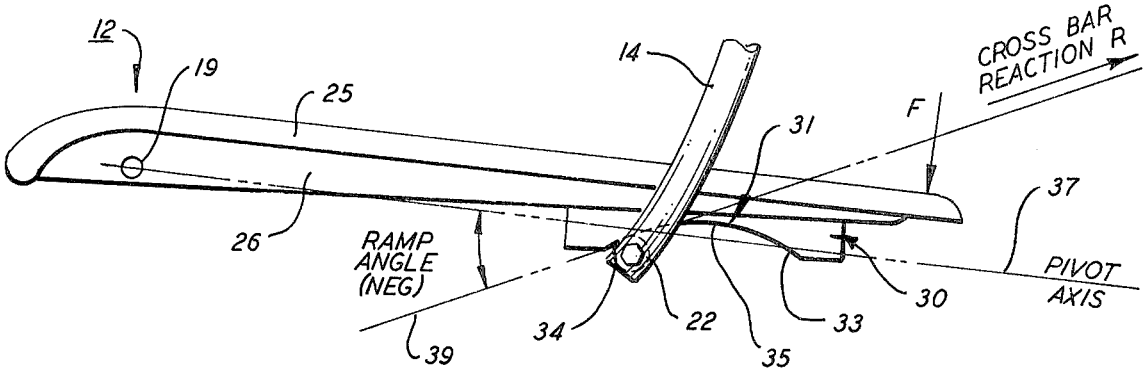

With further reference to FIGS. 3 and 4, a pair of slide members 30 are secured by any suitable means to the bottom surface of the board with the slides being mounted in parallel alignment along either leg of the bifurcated member 26.

A contoured working surface 31 is generated in the bottom of each slide in which is received the crossbar 22. The working surface of each slide includes a front ramp 33, a back ramp 34 and a transition section 35 cojoining the ramps to formulate a relatively smooth surface over which the crossbar moves as the system is deflected under load. As will be explained below, the slide members are adapted to automatically adjust the fulcrum ratio of the board in response to the induced load imparted to the system by a diver to promote increased flexibility of the system when placed under a relatively light load and to provide a stiffer response when the load is increased beyond a predetermined point.

When the board is at rest, as illustrated in FIG. 3, the crossbar 22 is seated in contact against the surface of the front ramp. The pivot axis 37 of the system at this time is situated in a generally horizontal plane. The slide plane of the forward ramp, however, is sloped upwardly and to the rear to establish a positive ramp angle with the pivot axis. The angle is referred to as being positive in that the ramp, acting against the crossbar, will promote or aid in the rearward movement of the crossbar when an initial load F is placed on the system.

Placing an initial load upon the diving end of the board causes the springs to deflect downwardly and to the rear and thus starts the crossbar down the front ramp. The crossbar reaction R is now generally along the slide plane 38 of the rmp so that the bar only has to overcome a minimum amount of resistance as it moves along the ramp. As a result, the bar moves smoothly to the rear decreasing the fulcrum ratio of the system and increasing the board's response in this particular region.

As the load F on the system increases beyond a given point, the dynamics of the system carries the crossbar from the front ramp and moves it into or through the transition section 35. In the transition section, the slope of the slide plane smoothly changes from a positive angle as shown in FIG. 3 to a negative angle as shown in FIG. 4. By design, the crossbar will reach the transition point when the system is placed under a predetermined load which typically is at or about 600 pounds.

As seen in FIG. 4, the crossbar, upon being carried through the transition region, begins to move up the back ramp 34 along slide plane 39. The slope of the ramp is generally upwardly and to the front of the board creating a negative ramp angle and producing a forward reaction R in the crossbar. The ramp thus resists further deflection of the system under increasing loads thereby increasing the fulcrum ratio of the system for a given load in this higher range. Accordingly, the rate of deflection of the system is decreased and a "stiffer" board is presented to the heavier or more active diver.

As can be seen from the disclosure above, the present diving system, through the contoured slide arrangement, automatically adjusts the linear deflection of the board in response to the weight and/or activity of the diver. A lighter weight or less active diver is provided with a relatively flexible or supple board while a heavier more active diver is presented with a stiffer board. Because of the smooth contour of the working surface generated in the slides, this change or alteration in response takes place with little or no board chatter or other disturbing effects. As a result, a diver, launching himself from the system, experiences a feel that is quite similar to a more conventional board of greater length.

Although two slide members are employed in the present embodiment of the invention, it should be clear to one skilled in the art that one or more contoured slides can be utilized without departing from the teachings of the present invention. The slide members can also be constructed of any suitable low friction material exhibiting high impact strength and good cold flow characteristics when employed in the environment of the present system.

Figure 5:
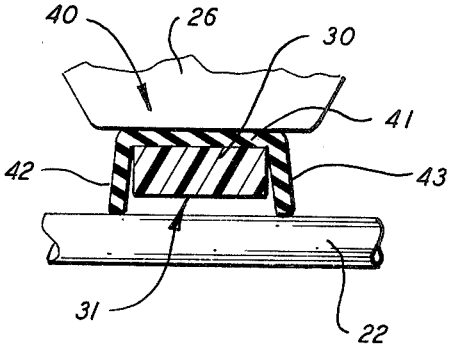
FIGS. 5 and 6 are fragmented end sections taken through a slide member used in conjunction with the diving system shown in FIG. 1 further illustrating the use of a resilient isolation pad to deaden rebound noise.
Figure 6:
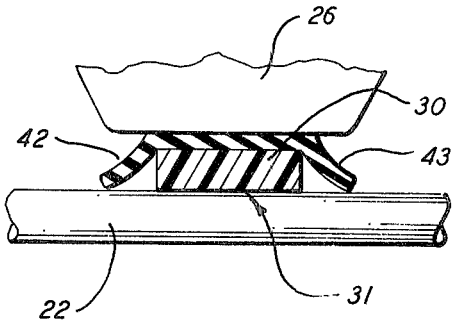

As illustrated in FIGS. 5 and 6, an isolating pad 40 is interposed between the bottom surface 26 of the board and the top surface of each slide member. The pad is formed of a resilient material, such as rubber or the like, capable of absorbing the impact shock produced by a rebounding board after a diver has been launched. The pad serves to isolate the noise of rebound and vibrations caused by the crossbar impacting against the slide member. The resilient pad further provides a surface capable of conforming to the generally rough undersurface of the board against which the slide is fully and evenly seated.

Preferably, the pad is U-shaped in cross-sectional form having a base section 41 and two side panels 42,43 which generally complement the geometry of the underlying slide member. The side panels extend downwardly below the bottom surface of the slide. As shown in FIG. 5, the panels are canted outwardly from the sides of the slide members to insure that the panels deform outwardly, or away from the slide, when the crossbar 22 is brought into contact against the working surface 31 thereof. This prevents the panels from being forced between the slide and the crossbar and thus degrading the performance of the system.

Upon rebound, the crossbar initially contacts the extended side panel of the isolation pads prior to its coming into contact with the relatively harder noise producing working surface of the slide members. After absorbing the initial shock of rebound, the side panels will flex outwardly thereby permitting the crossbar to contact the slides. The remaining energy of rebound is translated through the slide members to the base section 41 of the isolation pads thereby further isolating unwanted rebound noise. It should be further noted that the resilient pads also serve a secondary function in that they tend to dampen out the natural frequency of the system and thus permit the board to rapidly return to a rest position after a diver has been launched.

While the invention has been described with reference to the structure disclosed herein, this invention is not necessarily confined to the details as set forth and this application is intended to cover any modifications or changes as may come within the scope of the following claims.

I claim:

1. In a diving platform having a base member, a relatively short board which is pivotally connected at the back end thereof to the base, a pair of arcuate shaped spring arms secured at one end to the base member and extending upwardly and outwardly from the base member and a crossbar passing beneath the board supported in the free ends of said springs, the improvement comprising:

at least one slide member affixed to the bottom of the board having a contoured working surface for receiving the crossbar in sliding relationship therewith, the working surface of the slide having first and second ramp sections cojoined by a transition section;

said first ramp section being positioned to contact the crossbar when the board is at rest in a non-loaded condition, the slope of the ramp inclined upwardly and rearwardly in regard to the pivot point of the board;

said second ramp section being positioned rearwardly of said first ramp section, the slope of said second ramp being inclined upwardly and forwardly in regard to the pivot point of the board; and said transition section having a continuous surface extending between the two ramp sections capable of smoothly guiding the crossbar between the ramps as the load on the board is increased beyond a predetermined point.

2. The platform of claim 1 having two slides mounted in parallel alignment on either side of said board.

3. The platform of claim 1 further including a resilient pad interposed between said slide and the bottom surface of the board to cushion the board as it rebounds against the crossbar.

4. The platform of claim 3 wherein each resilient pad includes a pair of dependent side panels, each panel extending downwardly beyond the side surface of the slide whereby the crossbar moves into contact with the panels prior to contacting the working surface of the slides upon rebound.

5. The platform of claim 4 wherein the side panels are arranged to deflect away from the side surfaces of the slide when the crossbar is in contact with the working surface of the slides.

6. The platform of claim 1 wherein said slide is fabricated of a low friction material having good cold flow characteristics when placed under impact loading.

7. A self-adjusting diving platform of relatively short length including:

base member;

a board pivotally mounted at one end to said base member;

a pair of spaced apart arcuate shaped spring members secured in cantilevered fashion at one end in the base member and extending outwardly from said base each spring member extending along an edge of the board;

a crossbar secured to the free ends of said spring members said crossbar extending transversely and beneath the board; and at least one arcuate guide slide means affixed to the bottom surface of the board and extending substantially longitudinally the board and having a generally concave working surface formed therein for receiving and guiding the crossbar in sliding relationship therewith when said board is used by a person, in rearward movement of the crossbar when the board is loaded to a predetermined level and to resist rearward movement of the crossbar when the board is loaded beyond said predetermined level.

8. The platform of claim 7 wherein the working surface of the slide member includes two ramp sections that are cojoined by a transition section, the slope of the first ramp section being generally upwardly and rearwardly in reference to the pivot point of the board and the slope of the second ramp section being upwardly and forwardly in reference to the pivot point of the board.

9. The diving platform of claim 7 further including a resilient pad interposed between the bottom surface of the board and the top surface of the slide for absorbing the impact forces created by the board upon rebound.

10. The platform of claim 9 wherein the resilient pad has two side panels which complement the contour of the sidewalls of the slide member and which extend downwardly beyond the working surface of said slide whereby the cross member contacts the side panels prior to contacting the working surface of the slide.

* * * * *